US007642719B2

(12) United States Patent
Allen et al.

(10) Patent No.: US 7,642,719 B2
(45) Date of Patent: Jan. 5, 2010

(54) ENERGY EFFICIENT FLUORESCENT LAMP HAVING AN IMPROVED STARTING ASSEMBLY AND PREFERRED METHOD FOR MANUFACTURING

(75) Inventors: Gary Robert Allen, Chesterland, OH (US); William W. Beers, Chesterland, OH (US); Matthew Pierce, Cleveland Hts., OH (US); Evan Karrs, Gibsonia, PA (US); Edward Eugene Hammer, Mayfield Village, OH (US)

(73) Assignee: General Electric Company, Schenectady, NY (US)

( * ) Notice: Subject to any disclaimer, the term of this patent is extended or adjusted under 35 U.S.C. 154(b) by 665 days.

(21) Appl. No.: 11/103,800

(22) Filed: Apr. 12, 2005

(65) Prior Publication Data

US 2006/0226781 A1 Oct. 12, 2006

(51) Int. Cl.
*H01J 11/00* (2006.01)
*H01J 17/44* (2006.01)
*H01J 65/00* (2006.01)

(52) U.S. Cl. ..... 313/594; 313/234; 313/607

(58) Field of Classification Search ..... 313/500–506, 313/594, 623–625, 634–636, 318.12, 570, 313/318.01, 484–493; 118/50; 445/26, 27; 345/47

See application file for complete search history.

(56) References Cited

U.S. PATENT DOCUMENTS

| | | | | |
|---|---|---|---|---|
| 4,360,761 | A | 11/1982 | Roche | |
| 4,568,859 | A | 2/1986 | Houkes et al. | |
| 5,702,179 | A | 12/1997 | Sidwell et al. | |
| 5,925,988 | A | 7/1999 | Grave et al. | |
| 6,400,097 | B1 | 6/2002 | Jin et al. | |
| 6,456,005 | B1 * | 9/2002 | Panchula et al. | 313/567 |
| 6,628,079 | B2 | 9/2003 | Golkowski et al. | |
| 7,038,383 | B2 * | 5/2006 | Butler et al. | 313/595 |

FOREIGN PATENT DOCUMENTS

| | | | |
|---|---|---|---|
| JP | 2004 191507 | A | 7/2004 |
| JP | 2005 071942 | A | 3/2005 |

* cited by examiner

*Primary Examiner*—Toan Ton
*Assistant Examiner*—Elmito Breval
(74) *Attorney, Agent, or Firm*—Pearne & Gordon LLP

(57) ABSTRACT

A discharge lamp having a starting assembly is provided for use with existing high frequency electronic ballasts. The lamp comprises a light-transmissive envelope and has a discharge sustaining fill of an inert gas mixture of krypton and argon. The starting assembly comprises at least one conductive path attached to the outside or inside surface of the envelope or embedded in the envelope.

36 Claims, 7 Drawing Sheets

ENERGY EFFICIENT FLUORESCENT LAMP HAVING AN IMPROVED STARTING ASSEMBLY AND PREFERRED METHOD FOR MANUFACTURING

FIELD OF INVENTION

The present invention relates generally to a fluorescent lamp and more particularly to a lower wattage, energy efficient fluorescent lamp having an improved starting assembly.

BACKGROUND OF THE INVENTION

Standard T8 lamps utilizing only argon as the inert fill gas have a lower lumen efficacy, expressed as lumens per watt, as compared to argon/krypton energy efficient T8 lamps. These lower wattage T8 lamps yield reduced positive column power through addition of krypton to the fill gas. The addition of krypton reduces energy consumption in fluorescent lamps because krypton, having a higher atomic weight than argon, results in a lower wattage gradient in the positive column with lower heat conduction losses per unit length of discharge in the lamp. These lamps are known as GE Watt-Miser® lamps. However, the addition of krypton increases the peak voltage required to start the lamp, such that the lamp will not start on some ballasts, including many rapid start and programmed start ballasts. Thus, it is desirable to produce both a high efficiency lamp containing krypton capable of starting and operating on all existing ballasts so that the lamps can be rated for "Universal Operation on all ballasts".

In order to solve the above-mentioned problem, a starting assembly is used to effect reliable starting of lower wattage fluorescent lamps with or without krypton in the fill gas. The starting assembly provides an easier path for the electrons to flow during starting of the lamp thereby reducing the peak starting voltage requirement of the lamp.

One conventional starting aid consists of a conductive metal strip attached to the outside of the lamp. In a typical embodiment, the metal strip on the outside of a 1.5-inch (120 mm) circumference T12 fluorescent lamp is approximately ¼ inch (6 mm) wide and extends the length of the lamp. This method has several disadvantages. The major disadvantage is that the metal strip starting aid covers a relatively large percentage of the subtended circumference of the lamp envelope of approximately 5%. Since the metal strip extends nearly the entire length of the lamp envelope, it thereby covers approximately 5% of the surface area of the lamp envelope and therefore it absorbs or reflects approximately 5% of the light emitted by the lamp. Even though some of the light reflected by the metal strip is redistributed inside the lamp and is re-emitted, nonetheless the total emission of the lamp is reduced by a substantial amount of more than 1% due to absorption of light by the strip and inefficiencies inside the lamp. A second disadvantage of the wide metal strip is that it is visible to the customer at distances of four feet or more. Another disadvantage is that the metal strip is typically manually attached to the lamp with an adhesive and an insulating cover to prevent electric shock to the installer. This manual manufacturing process significantly increases the cost of manufacturing.

Another conventional starting aid consists of applying a conductive coating, such as tin-oxide, over the entire inside surface of the light transmissive envelope. Similar to the metal strip above, a major disadvantage to this method is that it covers 100% of the total surface area of the light transmissive envelope of the lamp, and the tin oxide coating absorbs some of the light emitted by the lamp. Thus, the tin-oxide also typically blocks over 1% of the lumens generated by the lamp.

Another disadvantage is that the tin oxide coating creates potential safety and lamp breakage concerns during the manufacturing process. Additionally, from an environmental perspective, a corrosive agent is required during the coating process. Still yet another disadvantage to this method is that it doesn't optimally perform on T12 lamps utilizing an electronic ballast.

Yet another conventional starting aid is using the metal lumiaire into which the lamp is mounted as the starting aid. However, as will be seen below the starting voltage required to start the lamp increases as the distance between the lamp and the starting aid increases. Thus, the greater the distance between the lamp and the starting aid the less efficient will be the starting aid. Further, this invention relaxes the requirements on the distance between the lamp and the metal luminaire, and even enables the use of non-conducting (e.g. plastic) luminaires, or even the elimination of the luminaire, while still providing excellent starting of the lamp.

To overcome the above-mentioned problem and disadvantages, the present invention claims that lower wattage fluorescent lamps can be made to start on all ballasts by adding a starting assembly to the lamp comprising an array of conductive paths to either the inside or outside surface of the lamp or by imbedding the conductive paths inside the lamp envelope.

BRIEF SUMMARY OF THE INVENTION

In accordance with one aspect of the present invention a lamp is provided comprising a light-transmissive envelope having a surface area and a starting assembly that includes at least one conductive path made from an electrically conductive or semi-conductive material operatively attached to the light-transmissive envelope that provides an electrically conductive path between a first and second electrode of the lamp, wherein the conductive path comprises no more than 4% of the total surface area of the light-transmissive envelope.

In accordance with another aspect of the invention a lamp is provided comprising a light-transmissive envelope having a surface area, multiple conductive paths made from an electrically conductive or semi-conductive material and operatively attached to the light-transmissive envelope where the conductive paths provide an electrically conductive path between a first and second electrode of the lamp and where the conductive paths are constructed and operatively attached to the light-transmissive envelope such that they comprise no more than 4% of the total surface area of the light-transmissive envelope.

In accordance with yet another aspect of the present invention a starting assembly for a lamp is provided comprising a light-transmissive envelope having a surface area and a conductive array made from an electrically conductive or semi-conductive material and operatively attached to the light-transmissive envelope where the conductive array provides an electrically conductive path between a first and second electrode of the lamp and where the conductive array is constructed and operatively attached to the light-transmissive envelope such that it comprises no more than 4% of the total surface area of the light-transmissive envelope.

DETAILED DESCRIPTION OF THE PREFERRED EMBODIMENTS OF THE INVENTION

As used herein, a 4-foot "T8 fluorescent lamp" is a fluorescent lamp as commonly known in the art typically 48 inches in length and having a nominal outer diameter of 1 inch. Alternatively, the T8 fluorescent lamp can be different lengths such as 2, 3, 5, 6 or 8 feet in length. Further the T8 fluorescent lamp may be nonlinear, for example circular or otherwise curvilinear, in shape. It should be noted that the present invention is not limited to use on T8 fluorescent lamps and that any reference to T8 lamps in the description is merely for illustrative purposes. The present invention can be utilized on any sized diameter linear or compact fluorescent lamp such as a T2, T3, T5, T12 lamp or any other fluorescent lamp whose length significantly exceeds its diameter as well as other types of discharge lamps, including HID lamps whose discharge chamber has a length significantly greater than its diameter or any other low-pressure discharge lamp such as neon lamps or cold-cathode discharge lamps.

Further, in the description that follows when a preferred range, such as 5 to 25 (or 5-25), is given, this means preferably at least 5, and separately and independently, preferably not more than 25. When a range is given in terms of a weight percent (wt. %) for a single component of a composite mixture, this means that the single component is present by weight in the composite mixture in the stated proportion relative to the sum total weight of all components of the composite mixture.

As used herein, "electronic ballast" means a high frequency electronic ballast as known in the art, comprising a light weight solid state electronic circuit adapted to convert AC input power from the mains supply, into a high frequency AC output power in the range of 20-150 kHz and more preferably 20-100 kHz, and having an output open-circuit voltage in the range of 100-1000V. The electronic ballast may be any type of electronic ballast known in the art adapted to operate a T8 fluorescent lamp such as an instant-start, preheat, rapid-start, programmed-start, etc.

As used herein, wattages are as measured on the standard ANSI 60 Hz rapid start reference circuit known in the art.

Figure 1:
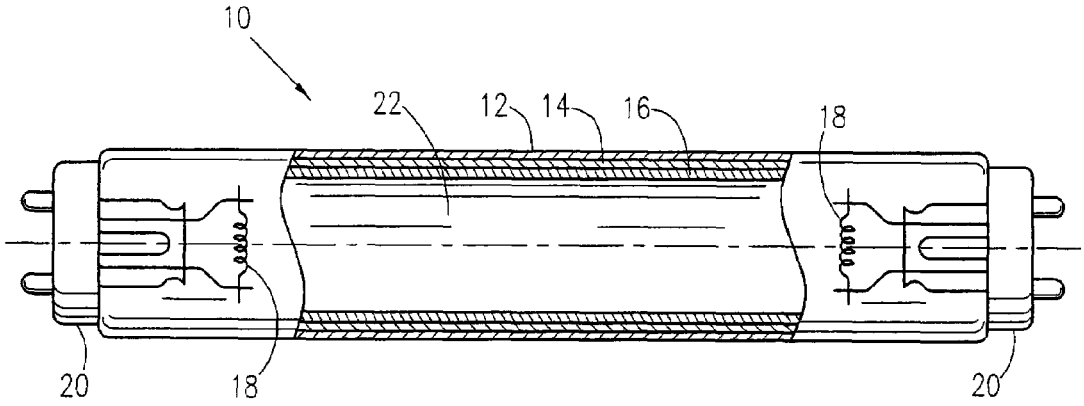
FIG. 1 shows in schematic form, with a section cutaway, a representative low-pressure mercury vapor discharge lamp according to the present invention.

FIG. 1 shows a low-pressure discharge lamp 10 according to the present invention. The discharge lamp 10 has a light-transmissive tube or envelope 12 made from a material such as glass, plastic, ceramic or any light-transmissive material in the art. The envelope 12 has a circular cross-section but it should be noted that the cross section of the envelope 12 can be any shape known in the art such as elliptical, rectangular, etc. The envelope 12 may have any length, diameter, and surface area. The inner surface of the envelope 12 is optionally coated with a reflecting barrier layer 14 of alumina or other ultraviolet (UV) reflecting material. The reflecting material is included for improved performance in some lamp constructions, but is omitted for improved performance in other lamp constructions. Preferably, the barrier layer 14 is in direct contact with the inner surface of envelope 12. The inner surface of the envelope 12 is also optionally coated with Layer 16 which is comprised of phosphors the specific nature of which is determined by the desired lamp spectrum. In some lamp constructions, which might be intended to provide an output of UV light, both the barrier layer 14 and the phosphor layer 16 may be omitted.

The lamp is hermetically sealed by a base 20 attached at each end and a pair of spaced electrode structures 18 (which are means for providing a discharge) are respectively mounted on the bases 20. A discharge-sustaining fill 22 of an inert gas is sealed inside the envelope 12. The fill 22 may also include mercury. The inert gas may comprise argon, krypton, xenon, neon, or helium, or any mixture thereof.

Fill gas mixtures of argon and krypton are generally known in the art for certain lamps. As such, the fluorescent lamp of the present invention employs a fill gas 22 comprising any mixture of krypton and argon. The addition of krypton reduces energy consumption in fluorescent lamps because krypton, having a higher atomic weight than argon, results in lower electron scattering and heat conduction losses per unit length of the discharge. However, a major disadvantage of krypton is that it suppresses the initial ionization thus increasing the voltage required to start the lamp, known as the starting voltage, thereby making the lamp difficult to start on ballasts with relatively high open-circuit voltages, especially some rapid start and programmable rapid start ballasts.

The present invention overcomes the starting problem by providing a starting assembly that reduces the starting voltage required to start the lamp. The starting assembly comprises electrically conductive paths 32 to form an electrically conductive array 30 that extends along the length of the envelope 12 where each end of the conductive array 30 is within a distance of each cathode 18 approximately 2 times the diameter of the lamp 10. For example, a T8 lamp having a diameter of 1 inch would be at a distance of 0-2 inches from the cathodes 18. It should be noted that both ends of the conductive array 30 do not have to be an equal distance from the respective cathode 18. In other words, for a T8 lamp one end of the array may be 1 inch away from one cathode 18 and the other end of the array may be 1.5 inches from the opposite cathode 18. The conductive array 30 may be attached to the inside or outside surface of the envelope 12 or may be embedded in the envelope 12. If the conductive array 30 is located on the outside of the envelope 12 an insulation layer covering the conductive array 30 may be required in order to prevent the installer from electric shock.

The conductive paths 32 that make up the conductive array 30 may be made from any type of conducting or semi-conducting material known in the art such as wire, conductive ink, etc. Preferred materials for the conductive paths include all metals, or their alloys, with resistivity below about $10^{-4}$ ohm-cm including, but not limited to Ag, As, Au, Ba, Be, Bi, Ca, Cd, Ce, Co, Cr, Cs, Cu, Dy, Er, Eu, Fe, Ga, Gd, Ge, Hf, Hg, Ho, In, Ir, K, La, Li, Lu, Mg, Mn, Mo, Na, Nb, Nd, Ni, Np, Os, Pa, Pb, Pd, Pr, Pt, Pu, Rb, Re, Rh, Ru, Sb, Sc, Se, Si, Sm, Sn, Sr, Ta, Tb, Tc, Te, Th, Ti, Tl, Tm, U, V, W, Y, Yb, Zn, Zr. This limit on resistivity of about $10^{-4}$ ohm-cm allows for the resistance of a barely visible conductor, with about 10 μm diameter, spanning the 1.2 meter length of a four foot fluorescent lamp to have a resistance of about 20 k-ohms or less. Non-metals, such as carbon, or semiconductors may also provide the required resistivity.

Figure 2A:
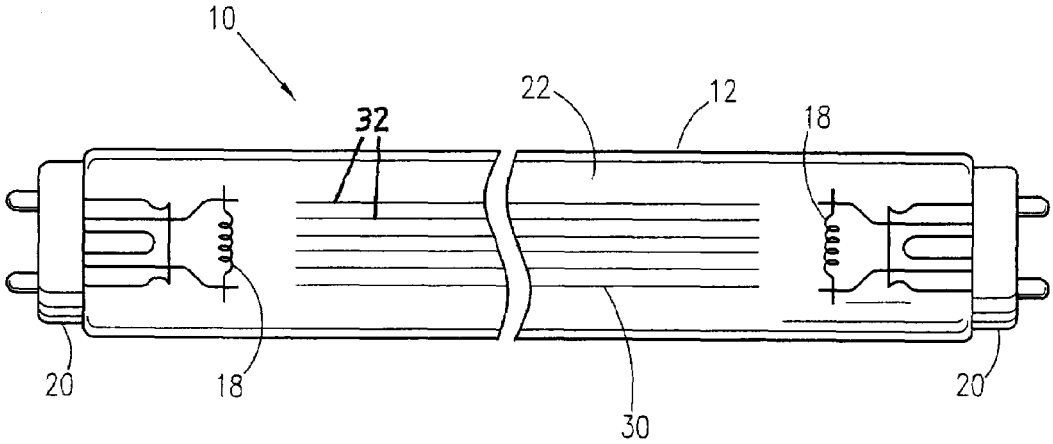
FIGS. 2*a*-2*g* show a lamp having a conductive array according to the present invention.
Figure 2B:
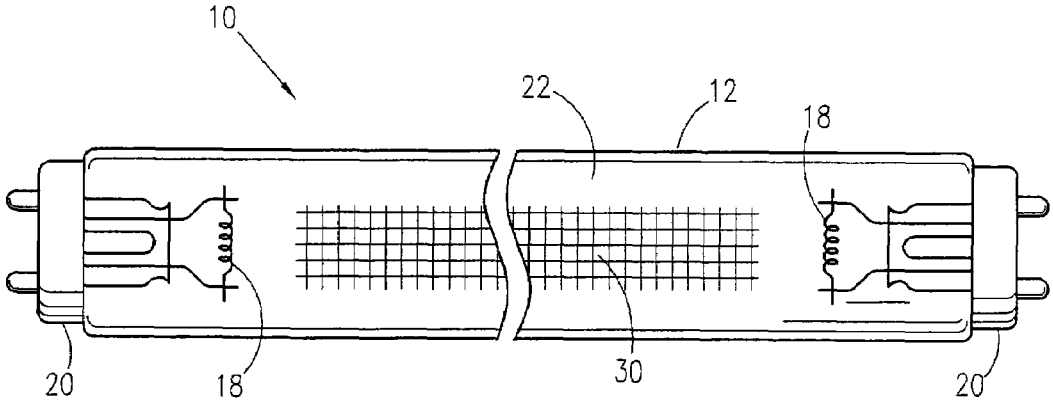
Figure 2C:
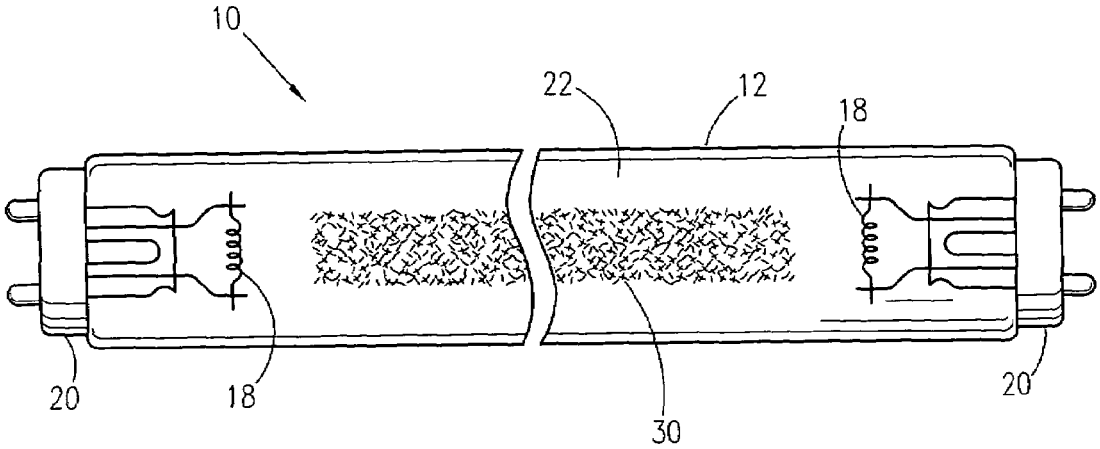
Figure 2D:
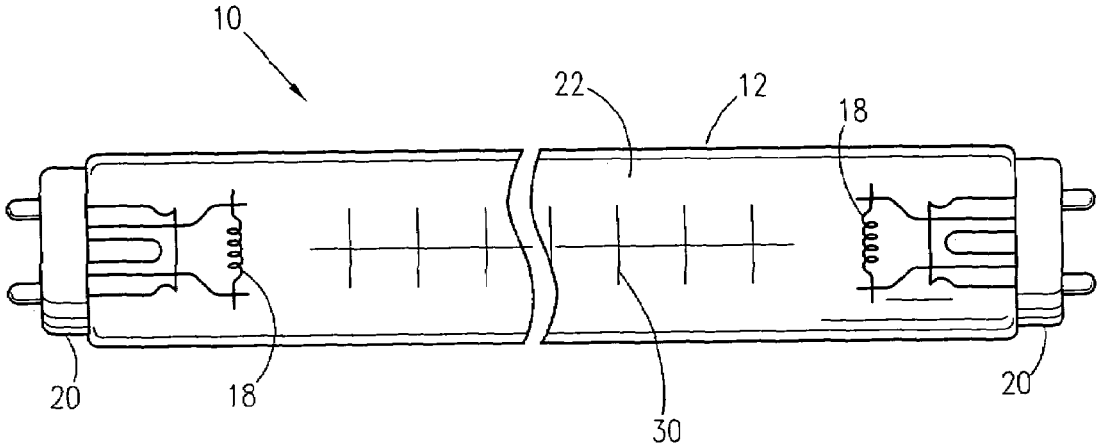
Figure 2E:
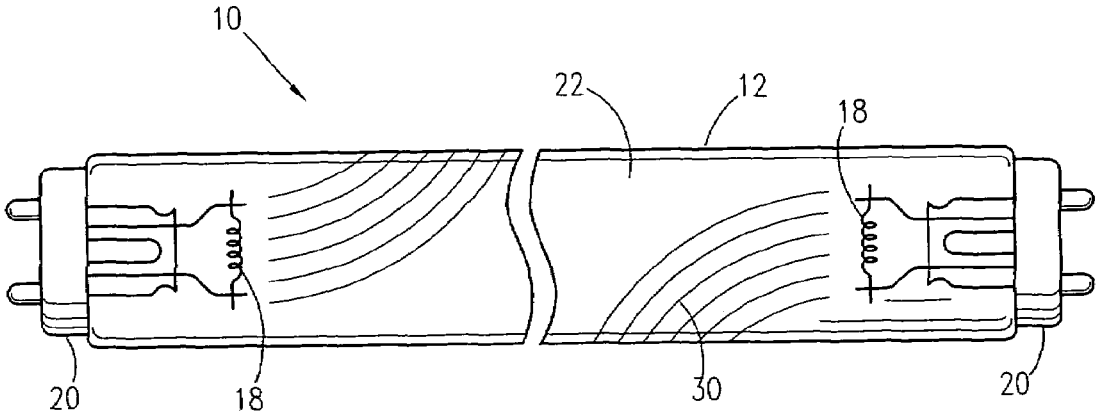
Figure 2F:
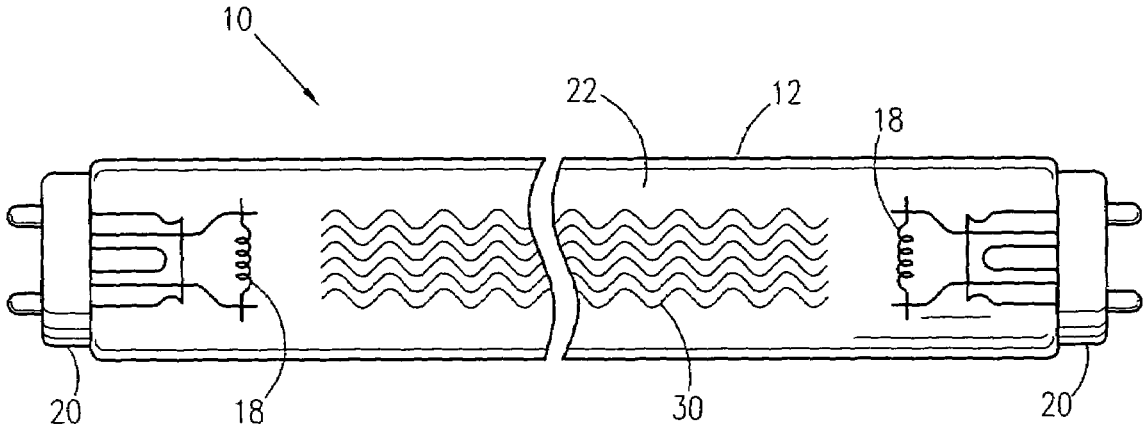
Figure 2G:
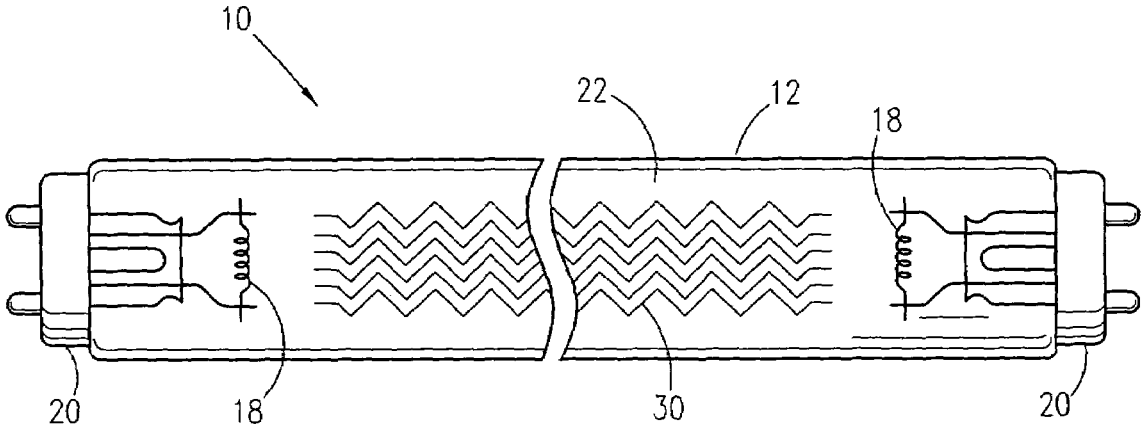

As shown in a preferred embodiment in FIG. 2*a*, the conductive paths 32 of the conductive array 30 extend substantially parallel from one end of the envelope 12 to the opposite end. It should be noted that the embodiment shown in FIG. 2*a* is not intended to limit the scope of the invention and is only for illustrative purposes to describe the present invention. For example, referring to FIGS. 2*b*-2*d* the conductive array 30 can have any random pattern or form for example, the conductive array 30 may be in the form of a mesh or randomly oriented nano-fibers or may even comprise at least one path extending along the length of the envelope 12 having multiple paths perpendicularly spaced along the at least one path, etc. It should be further noted that the conductive paths 32 that make up the conductive array 30 may be discrete (not connected to one another) or may be connected at any location along the conductive path. The conductive paths 32 may have any cross section known in the art such as round, square, rectangular, flat, etc. Thus, any reference made to the diameter of the conductive paths 32 below refers to the longest cross-sectional dimension of the conductive path 32 where the longest cross-sectional dimension is defined as the dimension in the transverse direction. It should be further noted that the conductive array 30 need not extend along the length of the envelope 12 in a linear fashion but may wrap around the envelope 12 in a helical fashion as shown in FIG. 2*e*, a sinusoidal fashion as shown in FIG. 2*f*, triangular fashion as shown in FIG. 2*g* or even in a disorganized asymmetric fashion.

In order to achieve a universal burn rating the starting voltage should preferably be less than 300 volts, more preferably less than 270 volts, and more preferably less than 260 volts. The starting voltage of a lamp varies depending on the mixture of the fill gas. The higher the concentration of krypton the higher the starting voltage required to start the lamp. It follows then that the reduction required in the starting voltage also varies depending on the mixture of the fill gas. For example, a lamp containing pure argon will only require a reduction in the starting voltage of approximately 60 volts and a lamp containing 65% krypton requires a reduction in the starting voltage of approximately 200 volts. In the example that follows a lamp having 27% krypton was used to collect data. It should be noted that this example is for illustrative purposes only and is not intended to limit the scope of the invention. Thus, the present invention can be used for a lamp having any mixture of argon and krypton including pure argon or pure krypton lamps. Therefore, although the starting volt reduction will vary with level of krypton it is possible to obtain a starting voltage as mentioned above.

Figure 3:
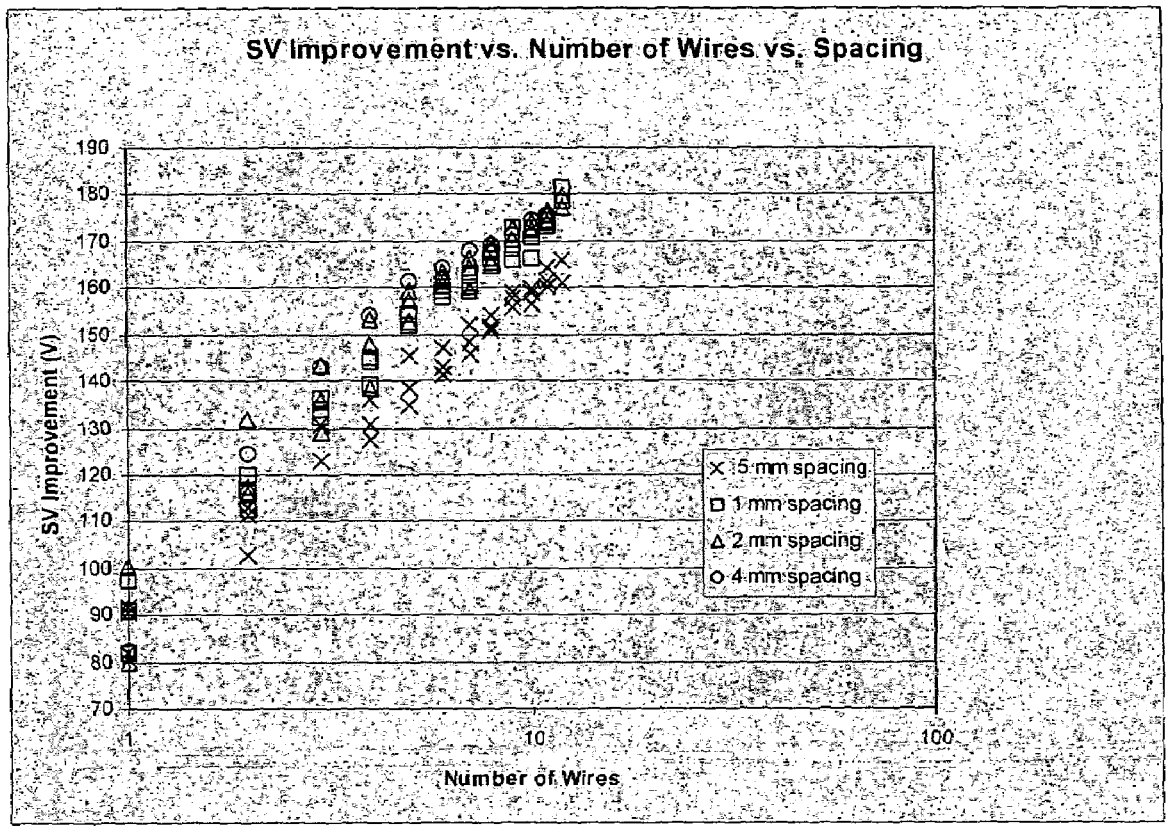
FIG. 3 shows a plot of the starting voltage improvement versus the number of conductive paths according to the present invention.
Figure 4:
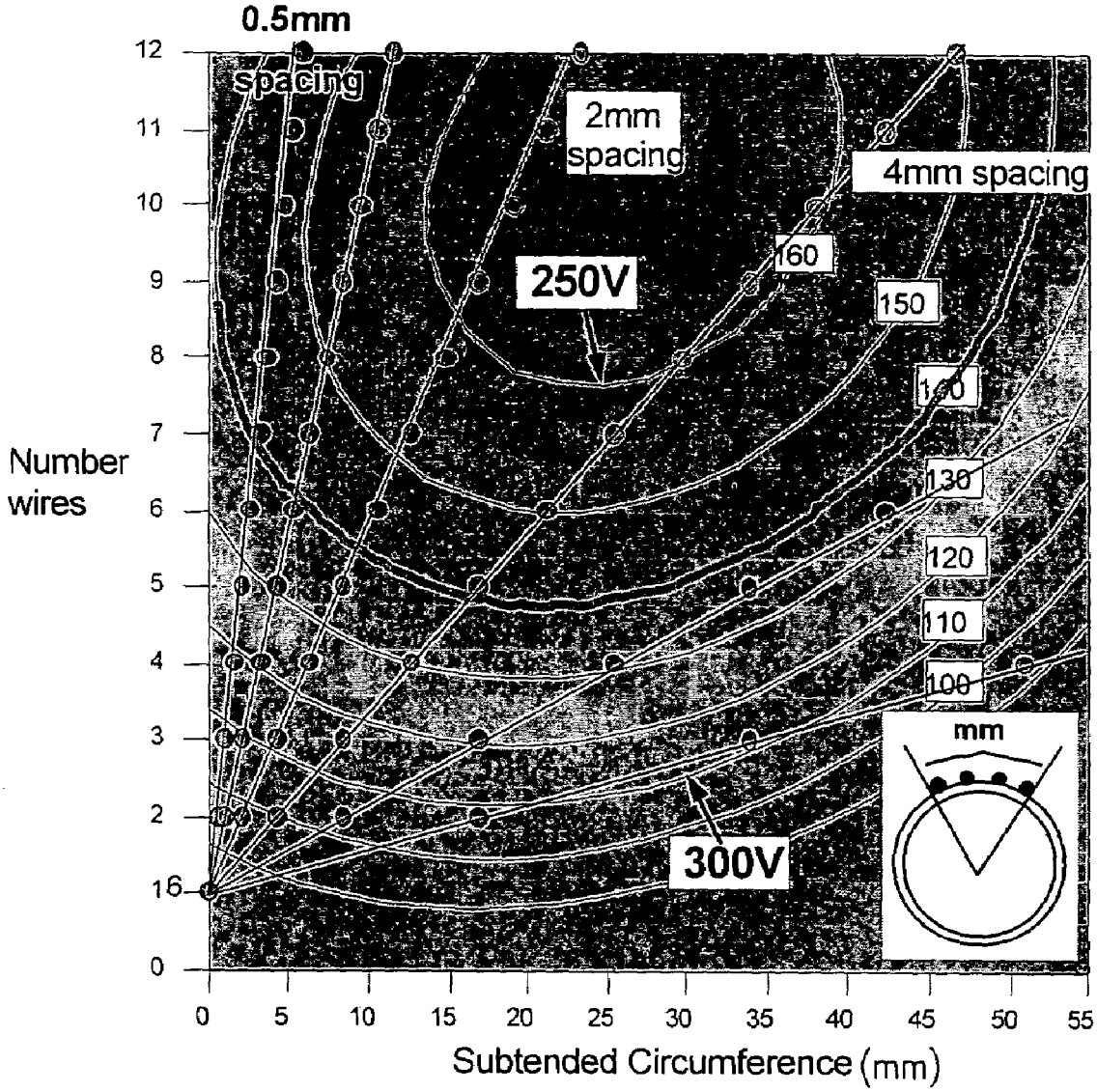
FIG. 4 shows a contour plot of the starting voltage improvement versus the number of conductive paths and the subtended circumference according to the present invention.
Figure 5:
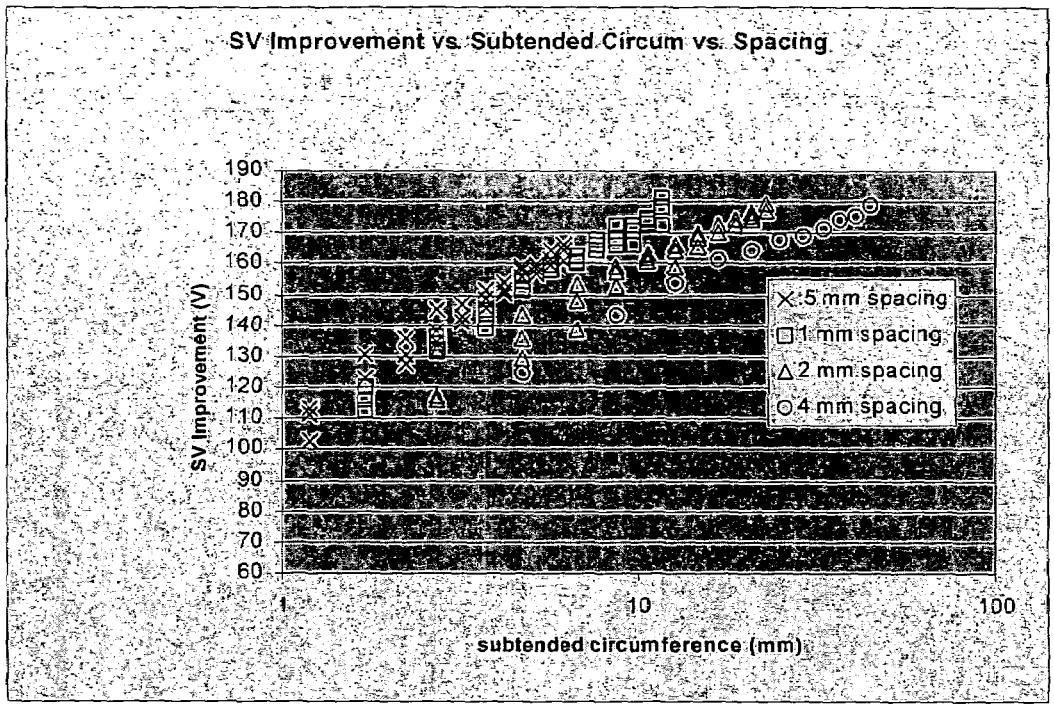
FIG. 5 shows a plot of the starting voltage improvement versus the subtended circumference according to the present invention.

A T8 lamp containing 27% krypton typically requires a starting voltage of approximately 420 volts depending on the level of krypton in the fill gas 22. Thus, it is desirable to improve or reduce the staring voltage by at least 120 and more preferably by at least 150 volts. FIGS. 3-5 illustrate how the starting voltage SV can be improved by varying the number of conductive paths N and the spacing S between the paths in the conductive array 30. The data contained in FIGS. 3-5 was obtained by mounting a F32T8 lamp, including a conductive array 30, dosed with 27% Kr and 73% Ar at a standard distance of ½" from a metal luminaire and operating the lamp with an instant-start ballast at 25 kHz. The conductive array 30 in this example was constructed by wrapping stainless steel wire onto a loom to thereby form a wire array. The loom maintained the wires in a parallel fashion and evenly controlled the spacing between the wires. Further, the loom enabled the wire array to be transferred to the lamp on a strip of transparent adhesive tape. Thus, the wire array was taped to the outside of the lamp extending the length of the lamp to approximately within 1" of each end of the lamp. In order to determine the required open circuit voltage to ignite the lamp the open circuit voltage of the ballast was gradually increased. In this example, experimental measurements of the starting voltage required to ignite such a lamp were obtained with a wire array having the following range of parameters: N=0-12, d=12, 25, 50, and 100 microns, and S=0.5, 1, 2, 4, and 8 mm, where N is the number of conductive paths, d is the diameter or the longest cross-sectional dimension of the wires, and S is the spacing between the wires. It should be noted that the diameter of the wires, in this range of diameters, had very little effect on the starting voltage. This will be also demonstrated further below in the analytic formula for the capacitance of the array of conductors.

Referring now to FIG. 3, the starting voltage (SV) Improvement, expressed in volts (V), is plotted as a function of the number of conductors N for various conductor diameters and conductor spacings S. The starting voltage (SV) Improvement is the reduction in the starting voltage (SV) for a given lamp with the conductive array relative to the starting voltage (SV) of the same lamp without the conductive array. Further, it should be noted that there are no other starting assemblies or aids, such as tin oxide, other than the conductive array attached to the lamp and the metal luminaire spaced ½" away from the lamp envelope. From the plot it can be seen that starting voltage (SV) Improvement using only 1 wire is substantial, approximately 80-100 V, but that the starting voltage (SV) Improvement is more than 150 V where N is greater than 5 and S is equal to 1-4 mm or where N is greater than 7 and S is equal to 0.5-4 mm. From the plot it can be seen that the benefit to the starting voltage (SV) Improvement made by adding more wires diminishes where N is greater than 10. The starting voltage (SV) Improvement itself does not diminish where N is greater than 10, but rather the rate of improvement per additional wire diminishes.

Referring now to FIG. 4, FIG. 4 further illustrates how the starting voltage (SV) decreases as the number of conductors N increase. The Y-axis represents the number of conductors N, the X-axis represents the circumference around the outside surface of the lamp that is subtended by the array of conductors, and the numbers in the boxes represent the starting voltage (SV) Improvement expressed in volts. The starting voltage (SV) required for this lamp without the conductive array is 410 V, so for example the box labeled 110 V corresponds to the contour for 300 V starting voltage. The 300 V contour is the target starting voltage and the 270 V contour represents a robust design target. From the plot it can be seen that the starting voltage is approximately 270 volts or less where N is greater than 5 and S is equal to 1-4 mm or where N is greater than 7 and S is equal to 0.5-4 mm. This is consistent with the plot in FIG. 3 where the starting voltage improved by 150 volts for the same parameters. Therefore, the number of conductive paths 32 that make up the conductive array 30 is preferably at least 2, more preferably 3-15, more preferably 4-12, more preferably 5-10, more preferably 7-9, more preferably 8-9.

Referring now to FIG. 5, the starting voltage SV is plotted as a function of the circumference of the envelope 12 that is subtended by the conductive array 30, where the subtended circumference equals S*(N−1), where N=1 to 12 for each of the various spacings between the wires S=0.5 to 4 mm. The plot illustrates that the starting voltage (SV) improves as the conductor spacing S increases from 0.5 mm to 1 mm, for a given number of wires N. This improvement is due to the increase in the width of the conductive array 30 which increases the capacitive effect of the array as will be described below. The plot further illustrates that the starting voltage (SV) Improvement does not increase as the conductor spacing is increased from 1 mm to 2 mm, in spite of the increased subtended circumference of the conductive array, because leakage of the electric flux between the conductors of the array, as will be described in detail further below, offsets the increased capacitive effect of the conductive array 30. In addition, a conductor spacing S of 4 mm, although not optimal due to leakage of the electric flux, still provides a significant improvement in the starting voltage. Thus, the spacing between the conductive paths is preferably 0.1 mm to 10 mm.

The starting voltage is also independent of the resistance of a conductor up to approximately 10-30 kohms. Thus, because resistance is a function of the conductor diameter the starting voltage is also independent of the conductor diameter down to a diameter of approximately 2-3 μm for conductors having a moderate electrical resistivity of approximately 15 μohm-cm, or even down to a diameter of approximately 1 micron or less for conductors having very good electrical resistivity of approximately 2 μohm-cm. Smaller conductor diameters are preferred so that the individual conductors are not easily visible to the customer, and also block a minimal amount of light from the lamp. Individual conductors are nearly invisible from typical viewing distances of a meter or more if the diameter or the longest cross-sectional dimension of the conductor is about 250 μm or less, more preferably about 50 μm or less, and more preferably 25 μm or less. Further, the fraction of the light emitted from the lamp that is blocked (absorbed and reflected) by the array of conductors is approximately equal to the fraction of surface area of the lamp envelope that is covered by the individual conductors in the array, which is approximately equal to the fraction of the circumference of the lamp envelope that is covered by the individual conductors in the array for the typical case where the conductors extend along approximately the entire length of the lamp. So, the fraction of light blocked is approximately $Nd/\pi D$, where D is the outside diameter of the lamp envelope. For a typical D of approximately 25 mm and N of approximately 10, the percentage of light blocked is 3% for d=250 microns, or 0.5% for d=40 microns, or 0.1% for d=8 microns, or 0.03% for d=2.5 microns. Therefore, the diameter or longest cross-sectional dimension of the conductors is preferably 0.25-250 μm, more preferably 0.25-50 μm, and more preferably 0.25-25 μm. As a result, the conductive paths 32 and ultimately the conductive array 30 may be produced such that the conductive array 30 is nearly invisible when attached to the envelope 12, and the conductive array 30 covers less than 4% of the total surface area of the lamp 10. As a result, the total lumens blocked by the conductive array 30 is typically less than 1.0%, preferably less than 0.5% and more preferably less than 0.1% of the base lumens generated by the lamp 10. Some of the light that is incident onto the conductive array 30 is reflected back into the lamp 10 and is re-emitted by the lamp 10, so that the reduction in output of the lamp 10 is less than the 0.1% and 0.5% amounts for a 10-conductor conductive array of 8 μm and 40 μm diameter conductors. In contrast, the light that is incident onto a solid metal strip 6 mm wide that extends the length of a 1" diameter lamp, as in the prior art, is 7.5%. Even though some of that light incident onto the solid metal strip is reflected back into the lamp and re-emitted, the total lumen output of the lamp is significantly reduced by more than 1%.

As previously mentioned, the circumference of the lamp envelope that is covered by the individual conductors in the array of the starting assembly can be used to determine the amount of lumens blocked by the starting assembly. As shown above, the ¼" metal strip, covering 7.5% of the circumference of the lamp envelope, blocks over 1% of the lumens. Thus, it is desirable to provide a starting assembly that blocks less than 1% of the lumens, more preferably less than 0.5% of the lumens, and more preferably less than 0.1% of the lumens. To achieve this it is desirable to provide a starting assembly such that the circumference of the lamp envelope that is covered by the individual conductors in the array is less than 4%, more preferably less than 1%, more preferably less than 0.5%, and more preferably less than 0.1%.

Figure 6:
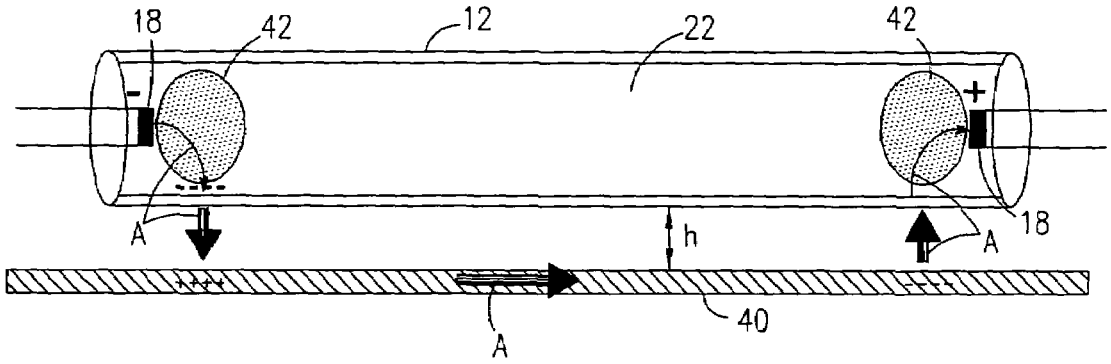
FIG. 6 illustrates a schematic of a lamp showing the current flow according to the present invention.

Referring to FIG. 6, the principle of capacitive coupling by which the conductive array 30 reduces the starting voltage will now be explained. Capacitive coupling occurs between the electrically conductive starting assembly 40 and the electrical charges on the surface of the plasma 42 inside the envelope 12. This principle is best understood by describing mechanisms involved during ignition of the lamp 10. As previously mentioned, the fluorescent lamp 10 contains a fill gas 22 that not only aids in the starting of the lamp 10 but also enhances the performance and life of the lamp 10. The fill gas 22 typically comprises argon in standard fluorescent lamps and a mixture of argon and krypton in the low-wattage Watt-Miser® lamps, which, as mentioned above, are harder to start. Prior to starting the lamp 10 and applying the voltage from the ballast the fill gas 22 inside the lamp has a very high impedance and is thus electrically insulating. The voltage required to overcome this impedance and breakdown and ignite the gas column axially across the entire distance between the lamp electrodes 18 typically exceeds the open circuit voltage provided by the ballast. The starting assembly 40 reduces the starting voltage by providing an alternative path for the current during starting of the lamp 10. Thus, in operation, the current path of the electrons during the initial breakdown period of the fill gas 22 does not travel axially through the fill gas 22 from one electrode 18 to the other electrode 18, but rather the path of the electrons, represented by the five arrows A, proceeds radially from one electrode 18 to the highly conductive starting assembly 40, along the length of the starting assembly 40, and then radially from the starting assembly 40 to the opposite electrode 18. The connections between the electrodes 18 and the ballast complete the electrical circuit.

The capacitive coupling principle can be further explained by the following formulas. Still referring to FIG. 6, in a typical fluorescent lamp 10 where the ballast operates on alternating current, the radial conductive path of the electrons A through the insulating envelope 12 is enabled by the displacement current ($I_d$) resulting from the capacitive coupling between the conductive starting assembly 40 outside the envelope 12 and the conductive plasma 42 inside the envelope 12, denoted as ($C_{sa}$). The displacement current ($I_d$) through the envelope 12 is proportional to the capacitance ($C_{sa}$) between the plasma 42 and the starting assembly 40 and is defined by Equation 1:

$$I_d = C_{sa}\, dV/dt = 2\pi f V_{oc}\, C_{sa}, \qquad \text{Equation 1:}$$

where $V_{oc}$ and f are the peak open-circuit voltage and frequency respectively of the voltage waveform from the ballast, assuming that the waveform is sinusoidal. Thus, according to the formula increasing the capacitance ($C_{sa}$) between the starting assembly 40 and the plasma 42 will increase the available displacement current ($I_d$) needed to start the lamp 10. In the conventional method explained above where the luminaire serves as the starting aid 40 the capacitance per unit length between the starting aid 40 and the plasma 42 is given in Equation 2 by the approximation for two infinite parallel plates $C_{plates}$ as:

$$C_{plates} = \epsilon\, wL/h, \qquad \text{Equation 2:}$$

expressed in Farads/meter where $\epsilon$ is the dielectric constant of the material between the plasma 42 and the starting aid 40, w is the circumferential width of the starting aid 40 and the plasma expressed in meters, L is the effective length, axially along the lamp, of the coupling between the plasma and the starting aid 40, expressed in meters, and h is the radial distance between the plasma 42 and the starting aid 40 expressed in meters. The assumption of an infinitely wide plate is not necessarily a good assumption for a starting aid that is ½ away from a lamp with a 1" diameter, but the simple formula is helpful in understanding the capacitive effect of the starting aid. Therefore, according to this formula, if the distance h between the plasma 42 and the starting aid 40 is decreased the capacitance ($C_{sa}$) between the plasma 42 and the starting aid 40 will increase thereby increasing the displacement current ($I_d$), and enabling a reduced starting voltage.

Typically, the distance h mentioned above between the metal luminaire starting aid 40 and the plasma is ½" (12 mm). Conventionally, this distance h has been reduced by applying the starting aid 40 directly to the outside of the envelope 12, in the form of a metal strip, or directly to the inside surface of the envelope 12, in the form of the tin oxide coating as described above. Applying the starting aid 40 directly to the envelope 12 greatly increases the capacitance coupling ($C_{sa}$) such that the starting voltage of the lamp 10 is independent of the luminaire. However, as mentioned above, a major disadvantage is that these conventional techniques block over 1% of the base lumens generated by the lamp 10. Further, a typical value for ($C_{sa}$) for the metal strip described in the prior art above applied to the outside surface of a fluorescent lamp where w~0.010 m, h~0.002 m, and L~0.010 m is ~0.44 pF. Typically the effective length, L, of the capacitive coupling between the plasma inside the envelope 12 and the starting assembly is very short, for example 10 mm, in the initial breakdown period while the gas is ionized only in a local region in front of each cathode. However, in the final phase of the breakdown, when the ionization regions in front of each of the two cathodes have each propagated toward the center of the lamp, leaving only a narrow axial extent of the gas un-ionized near the center of the lamp, then the effective length, L, of the capacitive coupling is approximately equal to the distance between the cathodes, for example about 1200 mm for a 4-foot long fluorescent lamp. So, the total capacitance between the plasma and the starting assembly increases in proportion to distance that the discharge propagates axially along the envelope 12. At the final phase of the breakdown, and during steady operation of the lamp, the capacitance of the metal strip would be increased to ~52 pF.

The conductive array 30 according to the present invention not only overcomes the disadvantage of blocking light but also provides the necessary capacitive coupling required to start the lamp 10. Thus, the capacitance between the plasma 42 and the conductive array 30 determines the voltage from the ballast required to start the lamp 10. An analytic formula for this capacitance is difficult due to the complex effects of electric flux leakage between the conductive paths 32 of the conductive array 30 and around the edges of the conductive array 30. However, simple approximations can be made that still provide insight into the performance and optimal design of the conductive array 30. First, the capacitance ($C_1$) between a single conductor and the plasma 42 is defined by Equation 3:

$$C_1=2\pi\epsilon L/\ln(2h/d) \qquad \text{Equation 3:}$$

expressed in Farads/meter where d is the diameter of the conductor if it is a round wire, or the width of the conductor if it is flat, expressed in meters. From this formula we can see that the capacitive coupling ($C_1$) between the single conductor and the plasma 42 is still dependent on the distance h between the conductor and the plasma 42. A typical value for $C_1$ for the dimensions pertaining to a conducting single-conductor starting assembly applied to the outside surface of a fluorescent lamp where d~0.00002 m, h~0.002 m, and L~0.010 m~0.10 pF.

Second, we can calculate the capacitive coupling ($C_N$) for an infinitely wide conductive array where the flux leakage at the edges of the conductive array can be neglected. Assuming that the conductors in the conductive array are evenly spaced, are parallel to each other, and are in the same plane parallel to the surface of the lamp envelope 12, the capacitance ($C_N$) is defined by Equation 4:

$$C_N=2\pi\epsilon L S (N-1)/\ln[(S/\pi d)/\exp(2\pi h/S)] \qquad \text{Equation 4:}$$

expressed in Farads/meter where N is the number of conductive paths 32 in the conductive array 30 and S is the spacing between the conductive paths 32 expressed in milli-meters. This equation is valid where 2 πh/S>>1. Since h is typically about 2 mm the formula is valid for a conductor spacing S up to about 6 mm.

A typical value for $C_N$ for the dimensions pertaining to a conductive array starting assembly applied to the outside surface of a fluorescent lamp where d~0.00002 m, N~10, S~0.001 m, h~0.002 m, L~0.010 m is ~0.33 pF, which is much better than the single conductor and comparable to the solid metal strip having the same width however, the conductive array blocks a negligible amount of light. As seen from Equation 4 if d is made ten times smaller or ten times larger, the capacitance is reduced or increased respectively by only approximately 15%. Thus, the capacitive effect of the array of conductors is relatively insensitive to the diameter or width of each individual conductor.

Figure 7:
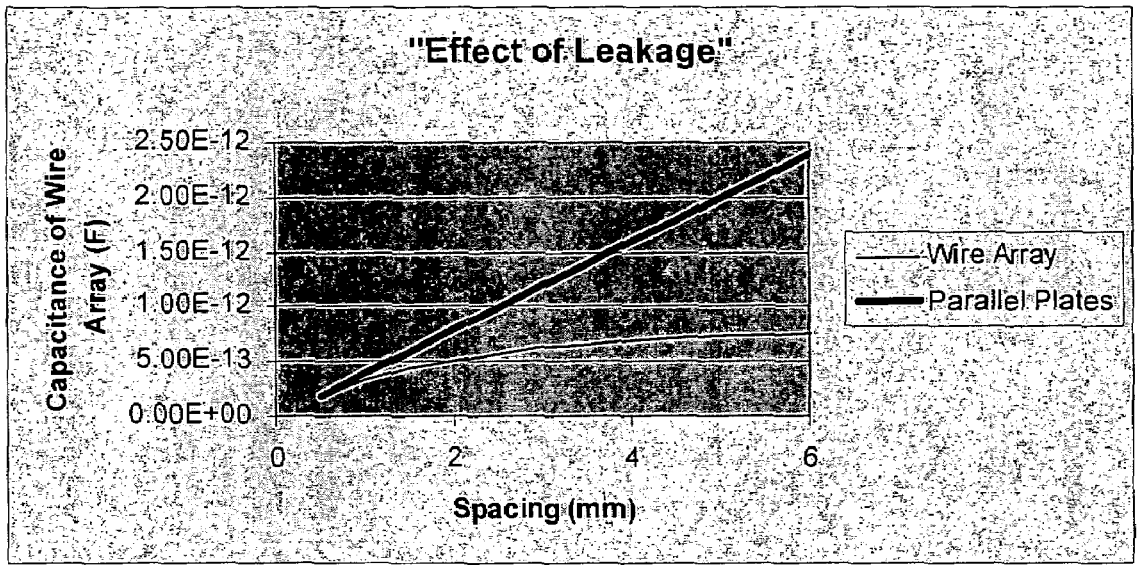
FIG. 7 is a comparison of the capacitance for a conductive array according to the present invention and the capacitance of the metal strip

Equations 2 and 4 can be compared to show the performance of a conductive array starting assembly relative to prior art metal strip starting assemblies in the plot in FIG. 7. For both the conductive array and the parallel plates, it is assumed that h=0.002 and L=0.010. For the conductive array 30, it is further assumed that d=0.000002 m, N=10, and S is varied as in the abscissa of the plot. The circumferential width of the conductive array around the outside of the envelope 12 is given by (N−1)*S. The capacitance for conductive array 30 is calculated vs. the spacing of the conductive paths 32, and the capacitance of the metal strip is calculated assuming a width that is the same as the width of the conductive array, for each value of S on the abscissa. It can be seen in the plot that the capacitance of the conductive array varies negligibly from that of the metal strip for S~0.001 m or less and is comparable to that of the metal strip even for S~0.002 m or a bit more. The value of S at which the deviation between the conductive array and the metal strip becomes significant is proportional to the value of h, which is assumed to be 0.002 m here, but larger values of h, up to about 0.005 m or even 0.01 m might be expected in typical lamps. The slightly lower capacitance of the conductive array might be explained as a "leakage" of the electric flux lines between the conductors of the conductive array, which becomes worse as the spacing S increases.

The conductive paths 32 can be applied to the lamp 10 in a variety of methods. For example, the conductive paths 32 can be applied to a piece of adhesive material and then apply the adhesive material to the lamp 10. Another method is to apply the conductive paths 32 to the lamp 10 during manufacturing of the envelope 12 while the envelope is hot. In this method the conductive paths 32 will adhere to the envelope 12 as the envelope 12 cools. Further, the conductive paths 32 may be drawn in the envelope 12 as the envelope 12 is being formed. Still yet another example is to apply the conductive paths 32 using an inkjet printer or other type of stamping or printing means. In this method a conductive ink can either be applied directly to the lamp envelope 12 or applied to an adhesive material and then apply the adhesive material to the lamp envelope 12. Still yet another example is to suspend nano-fibers of conducting or semi-conducting material in a slurry and apply the slurry to the inside or outside of the lamp envelope 12.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A fluorescent lamp for use with an electronic ballast comprising a light-transmissive glass envelope having a surface area and having an inner surface, a pair of spaced electrode structures, and a starting assembly for reducing the starting voltage including at least one conductive path made from a metal conductor or nanofiber operatively attached to the light-transmissive envelope that provides an electrically conductive path between said spaced electrode structures, wherein the conductive path comprises no more than 4% of the total surface area of the light-transmissive envelope.

2. The lamp of claim 1, wherein the at least one conductive path is operatively attached to the outside surface of the light-transmissive envelope, the inside surface of the light-transmissive envelope or imbedded within the light-transmissive envelope.

3. The lamp of claim 1 wherein the at least one conductive path longest cross-sectional dimension is 0.25-250 μm.

4. The lamp of claim 1 wherein the at least one conductive path longest cross-sectional dimension is 0.25-25 μm.

5. The lamp of claim 1 wherein the at least one conductive path blocks less than 1% of the base lumens generated by the lamp.

6. The lamp of claim 1 wherein the at least one conductive path blocks less than 0.5% of the base lumens generated by the lamp.

7. The lamp of claim 1 wherein the at least one conductive path blocks less than 0.1% of the base lumens generated by the lamp.

8. The lamp of claim 1 comprising a plurality of conductive paths wherein the conductive paths are regularly spaced parallel lines, arranged in a straight, or helical, or sinusoidal, or triangular, or other shifting pattern extending effectively the length of the lamp.

9. The lamp of claim 8 wherein the conductive paths are constructed and operatively attached to the light-transmissive envelope such that they comprise no more than 1% of the total surface area of the light-transmissive envelope.

10. The lamp of claim 9 wherein the conductive paths are constructed and operatively attached to the light-transmissive envelope such that they comprise no more than 0.5% of the total surface area of the light-transmissive envelope.

11. The lamp of claim 10 wherein the conductive paths are constructed and operatively attached to the light-transmissive envelope such that they comprise no more than 0.1% of the total surface area of the light-transmissive envelope.

12. The lamp of claim 8 wherein the number of conductive paths is 3-15.

13. The lamp of claim 8 wherein the number of conductive paths is 5-10.

14. The lamp of claim 1 wherein the at least one conductive path comprises a conductive array.

15. The lamp of claim 14 wherein the conductive array comprises one of a mesh, randomly oriented nano-fibers and ink.

16. The lamp of claim 14 wherein the conductive array blocks less than 1% of the base lumens generated by the lamp.

17. The lamp of claim 16 wherein the conductive array blocks less than 0.5% of the base lumens generated by the lamp.

18. The lamp of claim 17 wherein the conductive array blocks less than 0.1% of the base lumens generated by the lamp.

19. A fluorescent lamp for use with an electronic ballast comprising a light-transmissive glass envelope having a surface area and having an inner surface, a pair of spaced electrode structures, and a plurality of conductive paths for reducing the starting voltage, said plurality of conductive paths made from a metal conductor or nanofiber and operatively attached to the light-transmissive envelope; wherein the conductive paths provide an electrically conductive path between said spaced electrode structures, wherein the conductive paths are constructed and operatively attached to the light-transmissive envelope such that they comprise no more than 4% of the total surface area of the light-transmissive envelope.

20. The lamp of claim 19, wherein the conductive paths are operatively attached to the outside surface of the light-transmissive envelope, the inside surface of the light-transmissive envelope or imbedded within the light-transmissive envelope.

21. The lamp of claim 19, wherein the conductive paths are regularly spaced parallel lines, arranged in a straight, or helical, or sinusoidal, or triangular, or other shifting pattern extending effectively the length of the lamp.

22. The lamp of claim 21, wherein the spacing between adjacent conductive paths is 0.1-10 mm.

23. The lamp of claim 21, wherein the spacing between adjacent conductive paths is 0.5-4 mm.

24. The lamp of claim 21, wherein the spacing between adjacent conductive paths is 1- 2 mm.

25. The lamp of claim 22, wherein the conductive paths are constructed and operatively attached to the light-transmissive envelope such that they comprise no more than 1% of the total surface area of the light-transmissive envelope.

26. The lamp of claim 22, wherein the conductive paths are constructed and operatively attached to the light-transmissive envelope such that they comprise no more than 0.5% of the total surface area of the light-transmissive envelope.

27. The lamp of claim 22, wherein the conductive paths are constructed and operatively attached to the light-transmissive envelope such that they comprise no more than 0.1% of the total surface area of the light-transmissive envelope.

28. The lamp of claim 22, wherein the number of conductive paths is 3-15.

29. The lamp of claim 22, wherein the number of conductive paths is 5-10.

30. A fluorescent lamp for use with an electronic ballast comprising a light-transmissive glass envelope having a surface area and having an inner surface, a pair of spaced electrode structures, and a conductive array for reducing the starting voltage, said conductive array made from a metal conductor or nanofiber and operatively attached to the light-transmissive envelope; wherein the conductive array provides an electrically conductive path between said spaced electrode structures, wherein the conductive array is constructed and operatively attached to the light-transmissive envelope such that it comprises no more than 4% of the total surface area of the light-transmissive envelope.

31. The lamp of claim 30, wherein the conductive array is operatively attached to the outside surface of the light-transmissive envelope, the inside surface of the light-transmissive envelope or imbedded within the light-transmissive envelope.

32. The lamp of claim 31, wherein the conductive array has a resistivity of less than $10^{-4}$ ohm-cm.

33. The lamp of claim 31, wherein the conductive array is a regularly spaced array of parallel lines, arranged in a straight, or helical, or sinusoidal, or triangular, or other shifting pattern extending effectively the length of the lamp.

34. The lamp of claim 31, wherein the conductive array is constructed and operatively attached to the light-transmissive envelope such that it comprises no more than 1% of the total surface area of the light-transmissive envelope.

35. The lamp of claim 31, wherein the conductive array is constructed and operatively attached to the light-transmissive envelope such that it comprises no more than 0.5% of the total surface area of the light-transmissive envelope.

36. The lamp of claim 31, wherein the conductive array is constructed and operatively attached to the light-transmissive envelope such that it comprises no more than 0.1% of the total surface area of the light-transmissive envelope.

* * * * *

UNITED STATES PATENT AND TRADEMARK OFFICE

CERTIFICATE OF CORRECTION

PATENT NO. : 7,642,719 B2
APPLICATION NO. : 11/103800
DATED : January 5, 2010
INVENTOR(S) : Allen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 925 days.

Signed and Sealed this

Sixteenth Day of November, 2010

David J. Kappos

David J. Kappos
*Director of the United States Patent and Trademark Office*